United States Patent [19]

Toyoda

[11] Patent Number: 4,459,037

[45] Date of Patent: Jul. 10, 1984

[54] WRISTWATCH WITH PIEZOELECTRIC BUZZER

[75] Inventor: Mitsuru Toyoda, Suwa, Japan

[73] Assignee: Kabushiki Kaisha Suwa Seikosha, Tokyo, Japan

[21] Appl. No.: 546,069

[22] Filed: Oct. 27, 1983

Related U.S. Application Data

[63] Continuation of Ser. No. 241,774, Mar. 9, 1981, abandoned.

[30] Foreign Application Priority Data

Mar. 13, 1980 [JP] Japan ..... 55-31983
Nov. 13, 1980 [JP] Japan ..... 55-159950

[51] Int. Cl.[3] ..... G04C 21/00
[52] U.S. Cl. ..... 368/255; 368/72
[58] Field of Search ..... 310/321, 323, 324, 326, 310/327; 368/72, 255

[56] References Cited

U.S. PATENT DOCUMENTS 3,788,060 1/1974 Kawamura ..... 368/255
3,940,919 3/1976 Yasuda et al. ..... 368/255 X
3,943,388 3/1976 Massa ..... 310/324 X

*Primary Examiner*—Bernard Roskoski
*Attorney, Agent, or Firm*—Blum, Kaplan, Friedman, Silberman & Beran

[57] ABSTRACT

A wristwatch having a piezoelectric buzzer therein includes a watch case and a case back. The piezoelectric buzzer includes a piezoelectric element mounted on the case back inside the watch case. A driver selectively applies signals having a frequency of about 4 kHz to the buzzer. The case back, acting as the vibration plate for the piezoelectric element, is constructed so that the resonance frequency thereof is between 5.5 kHz and 7 kHz.

17 Claims, 10 Drawing Figures

FIG. 1
PRIOR ART
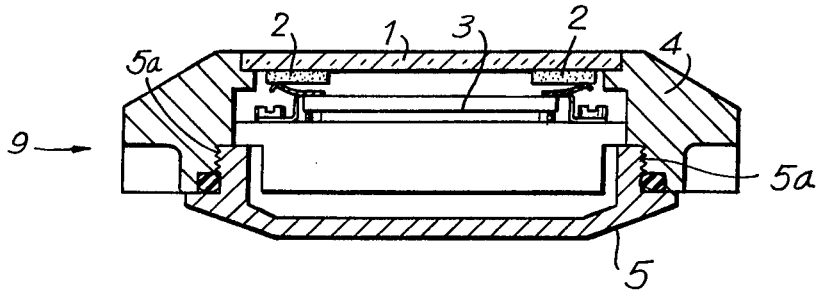
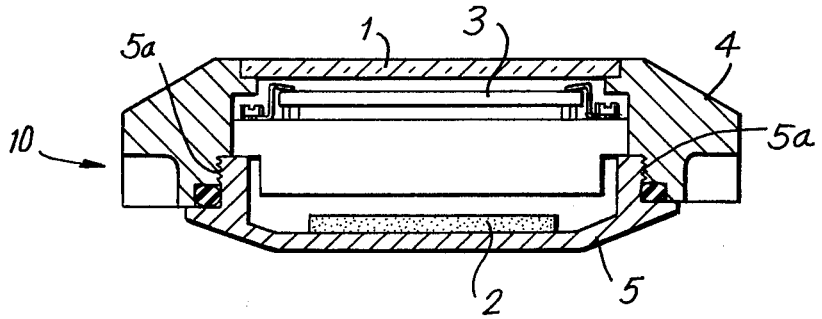
FIG. 2

FIG.3
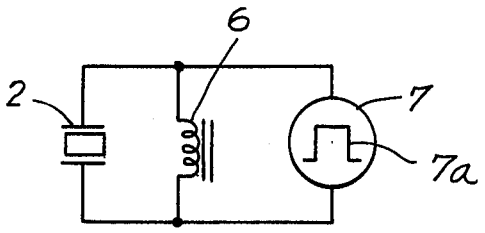
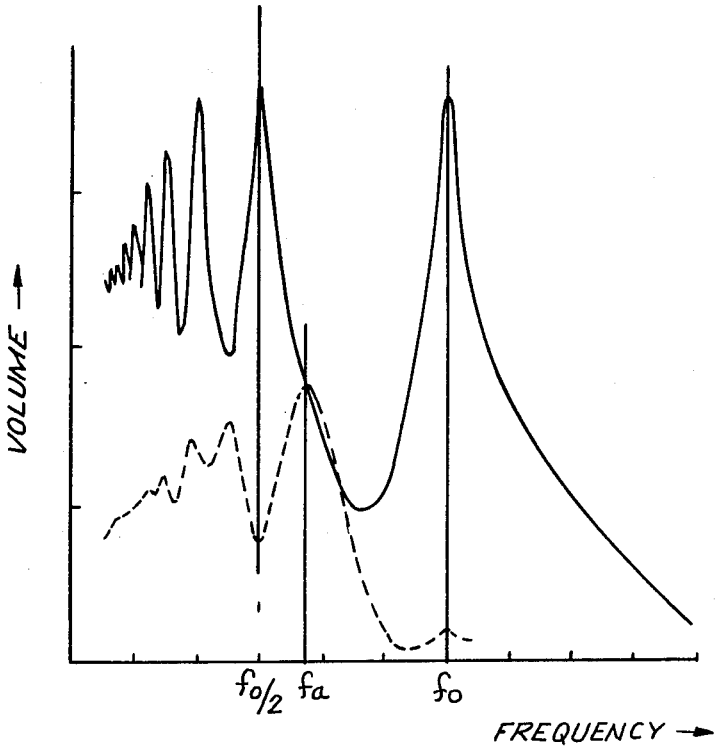
FIG.4

FIG.7
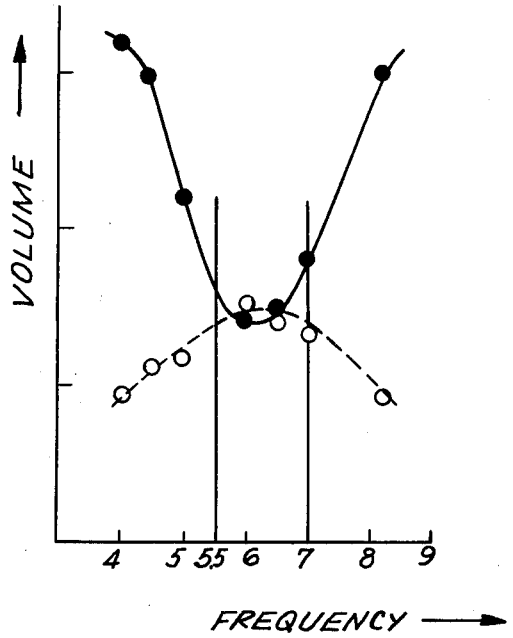
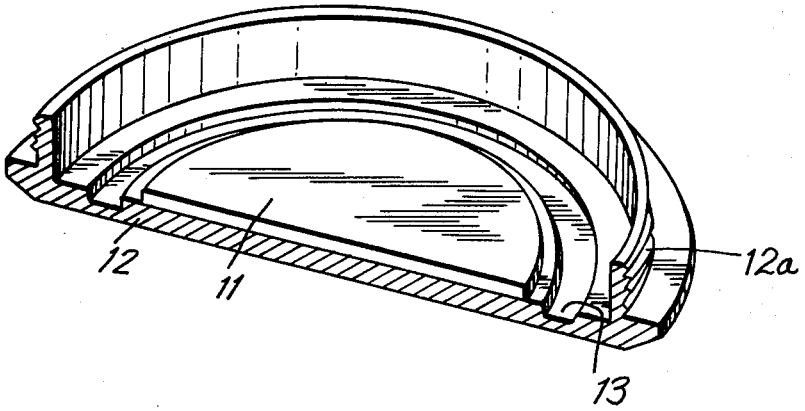
FIG.8

FIG. 9
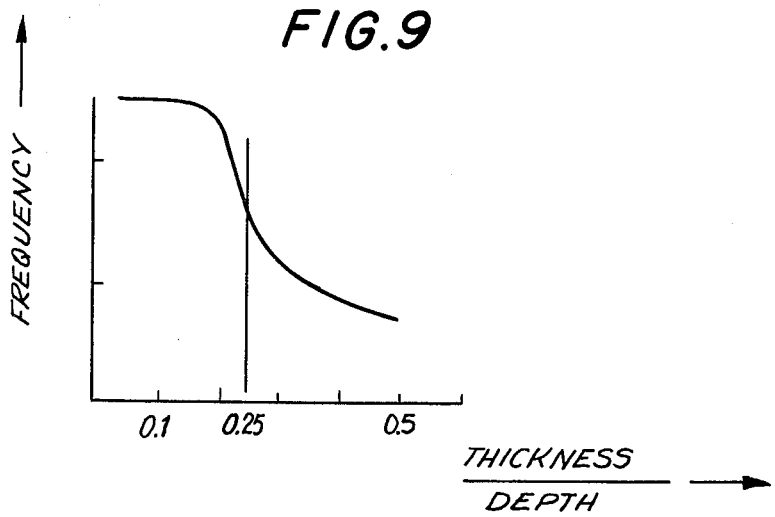
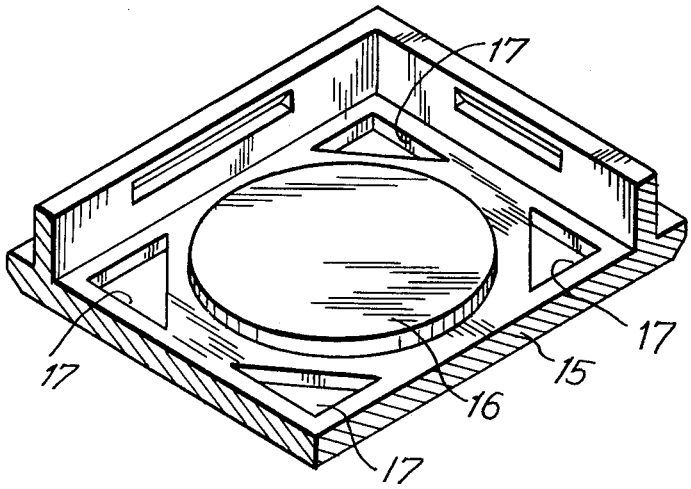
FIG. 10

WRISTWATCH WITH PIEZOELECTRIC BUZZER

This is a continuation of application Ser. No. 241,774 filed Mar. 9, 1981, now abandoned.

BACKGROUND OF THE INVENTION

This invention is directed to an electronic wristwatch having a sound-emitting device or alarm therein, and, in particular, to an electronic wristwatch including a piezoelectric element coupled to the case back cover of the wristwatch to form a piezoelectric buzzer.

In conventional wristwatches, an alarm or other sound-emitting device can be incorporated in the watch casing which is selectively driven by a driver in the watch circuit. One particular type of alarm utilized in wristwatches is the piezoelectric buzzer. The piezoelectric buzzer generally has a bi-morph construction and has the structure where the vibration plate, such a metal plate or the like, and the piezoelectric element are attached to each other with a binding agent or the like. The piezoelectric element can be attached to the cover glass of the watch so that the cover glass acts as the vibration plate of the buzzer. Alternatively, the piezoelectric element may be mounted in a centralized portion of the watch case wherein a separate vibration plate is provided therefor as in U.S. Pat. Nos. 3,879,931 and 4,180,970. In another embodiment, the piezoelectric element can be attached to the back cover or case back which acts as the vibration plate, as shown in the Official Japanese Gazette No. 33977-77.

The piezoelectric buzzer is simply constructed and can produce a loud sound with comparative low power consumption. Accordingly, in recent years, various products such as timekeeping devices, incorporating piezoelectric alarm constructions are on the market. However, in wristwatches, where the piezoelectric buzzer is attached to the case back of the wristwatch, the case back acting as the vibration plate of the piezoelectric element, it is found that the sound pressure level or volume of the buzzer is substantially decreased when the wristwatch is worn as compared to when it is not worn since the wrist of a wearer presses against the case back.

The shape and construction of the case back of a wristwatch where the piezoelectric element is attached thereto was only designed with considerations of strength and design in mind. Thus, the natural frequency of the case back was not considered.

Accordingly, a very thick case back was used, for example in a water-resistant watch requires high pressure resistance. Alternatively, a very thin case back was used in a thin type watch with only design considerations in mind. Thus, consideration was not given to constructing the back cover in such a way that the natural characteristics thereof could be utilized in connection with a piezoelectric element attached thereto so that the volume of the buzzer does not substantially vary when the watch is worn from when it is not worn.

Accordingly, an electronic wristwatch including a piezoelectric element attached to the case back which acts as the vibration plate of the buzzer wherein the buzzer volume does not substantially vary when the watch is either worn or not worn, is desired.

SUMMARY OF THE INVENTION

Generally speaking, in accordance with the invention, a wristwatch having a piezoelectric element therein attached to the case back of the wristwatch which overcomes the disadvantages of conventional sound-emitting wristwatches, is provided. A wristwatch constructed in accordance with the invention includes a piezoelectric element coupled to the case back of the watch inside the watch case. The buzzer is driven by a driver which supplies a driving frequency of about 4 kHz. The case back acts as the vibration plate of the buzzer and is formed so that the resonance frequency thereof is between 5.5 kHz and 7.0 OkHz. This construction provides for substantially equal buzzer sound volume when the wristwatch is worn and when it is not worn.

Accordingly, it is an object of this invention to provide an improved wristwatch having a sound-emitting device therein.

Another object of the invention is to provide an improved electronic alarm wristwatch having a piezoelectric buzzer alarm.

Still another object of the invention is to provide a wristwatch having a piezoelectric element coupled to the case back of the watch where the volume of the buzzer sound does not vary substantially when the watch is worn from when the watch is not worn.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a cross-sectional view of a wristwatch having a piezoelectric buzzer therein constructed in accordance with the prior art;

FIG. 2 is a cross-sectional view of a wristwatch having a piezoelectric buzzer therein constructed in accordance with the instant invention;

FIG. 3 is a schematic diagram of the driving circuit of a piezoelectric buzzer;

FIGS. 4, 5 and 6 are graphs depicting various frequency verses volume characteristics of a piezoelectric buzzer;

FIG. 7 is a graph depicting the experimental volume differences when an alarm wristwatch is worn and not worn;

FIG. 8 is a sectional perspective view of the back cover of a wristwatch constructed in accordance with the instant invention;

FIG. 9 is a graph depicting the relation between the buzzer volume and the back cover construction depicted in FIG. 8; and FIG. 10 is an alternative embodiment of the back cover of a wristwatch constructed in accordance with the instant invention.

DESCRIPTION OF THE PREFERRED EMBODIMENTS

Figure 5:
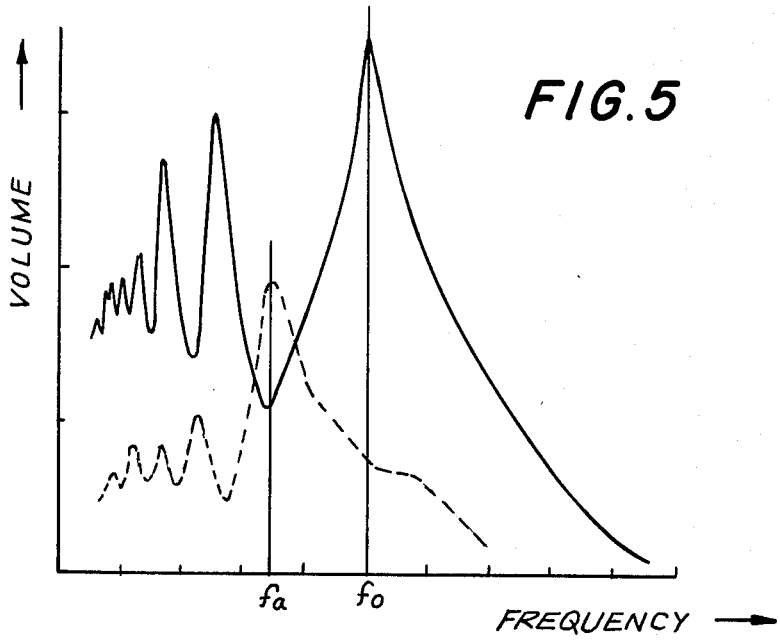

Reference is first made to FIG. 1, wherein an alarm wristwatch, generally indicated at 9, constructed in accordance with the prior art, is depicted. A watch mounting case 4 includes a cover glass 1 on the upper surface thereof for permitting viewing inside watch case 4. A display panel 3 mounted within watch case 4 displays the timekeeping information of the wristwatch. Watch case 4 also includes a back cover or case back 5 which is secured to the bottom of watch case 4 in an appropriate manner such as by screwing case back cover onto watch case 4 by means of threads 5*a*.

A piezoelectric element 2 is attached to the periphery of cover glass 1 in an appropriate manner such as by a binding agent or the like. Piezoelectric element 2 and cover glass 1 form the piezoelectric buzzer. In this construction, cover glass 1 acts as the vibration plate of the piezoelectric buzzer the element 2 on the surface of the cover glass 1 is always visible. The sound pressure level or volume of the buzzer does not substantially change when the watch is worn as opposed to when it is not worn since the cover glass does not contact the skin of a wearer when the watch is worn. Where a small sized wristwatch having a large display panel 3 and a small watch case 4 is desired, piezoelectric element 2 must be attached to an extremely narrow area on cover glass 1. Therefore, it is practically impossible to make the volume of the buzzer loud. Also, the piezoelectric buzzer will have a bad tone and the vibration mode thereof will be complicated because the piezoelectric element 2 cannot be disposed near the center of cover glass 1 but must be disposed on the edge of cover glass 1 as depicted in FIG. 1.

Reference is now made to FIG. 2, wherein a wristwatch, generally indicated at 10, and constructed in accordance with the instant invention, is depicted. Wristwatch 10 includes a watch mounting case 4 and a cover glass 1 secured to the top of case 4. A display panel 3, which provides the relevant timekeeping data to a wearer, is mounted in watch case 4 below cover glass 1 so as to permit viewing of display 3 through cover glass 1. A back cover or case back 5 is secured to case 4 in an appropriate manner such as by screwing back cover 5 onto case 4 by means of threads 5*a*. A piezoelectric element 2 is attached to back cover 5 in an appropriate manner such as by a binding agent or the like.

Piezoelectric element 2 and case back 5 together form the piezoelectric buzzer. Where piezoelectric element 2 is coupled to case back 5, case back 5 acts as the vibration plate for the piezoelectric buzzer. Piezoelectric element 2 attached to case back 5 (FIG. 2) can have a substantially larger diameter than when piezoelectric element 2 is attached to the cover glass 1 of the wristwatch (FIG. 1) and can accordingly cover a larger surface area and can be attached to a central portion of the back cover so that the whole case back 5 acts as the vibration plate of the buzzer. The sound pressure level or volume of the buzzer will be high and the tone of the buzzer will be good due to the single vibration mode of case back 5. Moreover, the simple vibration mode by which the fundamental natural frequency of case back 5 is provided, can be obtained since the portion around the center of case back 5, which acts as the vibration or emitting plate of the buzzer, is caused to vibrate.

However, even though the piezoelectric buzzer where the piezoelectric element 2 is attached to case back 5 has the advantages indicated above, where the case back contacts the wrist of a wearer and accordingly presses against the skin of a wearer, the volume of the buzzer will substantially decrease so that the piezoelectric buzzer, defined by piezoelectric element 2 attached to case back 5 which does not take into account the natural resonance frequency of case back 5, is not for practical use.

The instant invention is directed to constructing case back or back cover 5 so that the difference between the sound pressure level or volume of the piezoelectric buzzer is as low as possible when the wristwatch is worn as opposed to when it is not worn. Hence, the simple structure of a piezoelectric element directly mounted on the back cover as depicted in FIG. 2 can still be utilized.

Referring to FIG. 3, the driving circuit of the piezoelectric buzzer will now be described. Piezoelectric element 2 is coupled in parallel to a boosting coil 6 which in turn is connected in parallel to a driver 7 which supplies a driving pulse wave 7*a*. Pulse wave 7*a* is applied across boosting coil 6 which in turn drives piezoelectric element 2. The sound is emitted from piezoelectric element 2 by applying the self-induced voltage of boosting coil 6 thereto which generates a signal at the time that pulse waves 7*a* breaks off.

Referring now to FIG. 4, the frequency characteristic of the driving mode depicted in FIG. 3 will be described. In FIG. 4, the axis of the abscissa represents the frequency of the signal applied to piezoelectric element 2 and the axis of the ordinate represents the sound pressure level or volume of piezoelectric element 2. The solid line in FIG. 4 represents the characteristics where case back 5 is not in contact with the wrist of a wearer and the broken line in FIG. 4 depicts the characteristics where the case back 5 presses against the wrist of a wearer when the watch is worn. When the cycle of applying the self-induced voltage of boosting coil 6 to piezoelectric element 2 becomes $f_o/n$($f_o$=natural frequency of the piezoelectric buzzer, n=integer), the polarity of the voltage which is generated by the vibration of the piezoelectric element 2 coincides with the polarity of the applied voltage, so that the vibration of the piezoelectric element is excited. As a result, as shown by the solid line in FIG. 4, the volume peaks are obtained at the basic resonance frequencies or natural frequencies $f_o$ and $f_o/n$ (n=integer). This frequency characteristic appears where case back 5 is either snapped or screwed onto watch case 4. The case back 5 and watch case 4 are directly engaged with each other and the vibration is not substantially affected by the mounting portion (threads) of the back cover. This frequency characteristic is not obtained where there is a loose engagement between the case back 5 and watch case 4 or where an elastic material such as a sealant lies between case back 5 and case 4.

The frequency characteristics of the wristwatch when it is worn will now be considered. When the watch is normally worn, case back 5 sinks into the skin of the wrist of a wearer. The frequency characteristic when the watch is worn is shown by the broken line in FIG. 4. Even where the case back 5 is strongly pressed against the wrist of a wearer, the frequency characteristic does not substantially change from when the watch is slightly pressed against the wrist of a wearer. Accordingly, the broken line of FIG. 4 may be regarded as the frequency characteristic when the watch is worn. Experiments indicate that (1) the vibration of the back cover is restrained by the wrist, and as a result, the volume or sound pressure level is substantially decreased and (2) since the sound which the back cover emits into the air is changed to be emitted to the skin of the wrist, the equivalent masses which are caused by the radiation impedence of the sound are loaded to the vibratory system of the back cover, so that the natural frequency or basic resonance frequency $f_o$ of the back cover decreases.

Where case back 5 acts as the vibration plate of the piezoelectric buzzer, when the mass of the case back is M and the spring contant of the case back is set to be K, the natural frequency $f_o$ is represented by the formula (a) as is known in the field of vibration mechanics, $$f_o = \frac{1}{2\pi}\sqrt{\frac{K}{M}}. \quad \text{(a)}$$

When the additional mass is caused by the radiation impedence into the skin as described above is m, the natural frequency of the back cover when a watch is worn is represented by formula (b), $$f_a = \frac{1}{2\pi}\sqrt{\frac{K}{M+m}}. \quad \text{(b)}$$

By combining formula (a) with formula (b) the following formula of $f_a$ in terms of $f_o$ is obtained, $$f_a = \frac{1}{\sqrt{1+\frac{m}{M}}}\cdot f_o. \quad \text{(c)}$$

By referring to formula (c), the decreasing rate of the natural frequency of case back 5 is determined by the ratio of the case back 5 mass M to the additional mass m caused by the pressing of the back cover against the skin of the wearer. This ratio is determined by the area and the thickness of the case back. Where the piezoelectric element 2 of the piezoelectric buzzer is directly attached to the case back 5 of watches of the sizes presently on the market, that is, from a woman's watch of about 1.5 cm diameter to the men's watch of about 3 cm across, the decrement does not substantially change. The natural frequency $f_a$ when the watch is worn is about 60 to 70% of the natural frequency $f_o$ when the watch is not worn. Accordingly, as depicted in FIG. 4, $f_a$ is situated at the position showing 60 to 70% of In the frequency characteristics shown by the solid line in FIG. 4 when the watch is not worn, there are frequencies at which the vibration of piezoelectric element 2 does not coincide with the cycle of the application of the voltage from boosting coil 6 between $f_o$ and $f_o/2$. Additionally, the interval of the frequency between $f_o$ and $f_o/2$ is much wider than that of the high volume level of other excitations, for example, the interval between $\frac{1}{3}$ and $\frac{1}{4}$ of $f_o$. Accordingly, the sound pressure level or volume is lowered in this interval as depicted in the graph in FIG. 4. When the frequency near $f_a$ is considered, the sound pressure level when the watch is worn is substantially equal to the sound pressure level when the watch is not worn. If the sound pressure level of the piezoelectric buzzer near frequency $f_a$ when the watch is not worn is made to be almost the same as the sound pressure level when the watch is worn, and the driving frequency of the piezoelectric buzzer is set to be the frequency $f_a$ or the frequency near $f_a$, it is possible to obtain a piezoelectric buzzer in which a person does not sense the minimal difference of the sound pressure levels between when the watch is worn and when the watch is not worn. However, the natural frequency of the back cover must be determined in order to put the piezoelectric buzzer to practical use.

Figure 6:
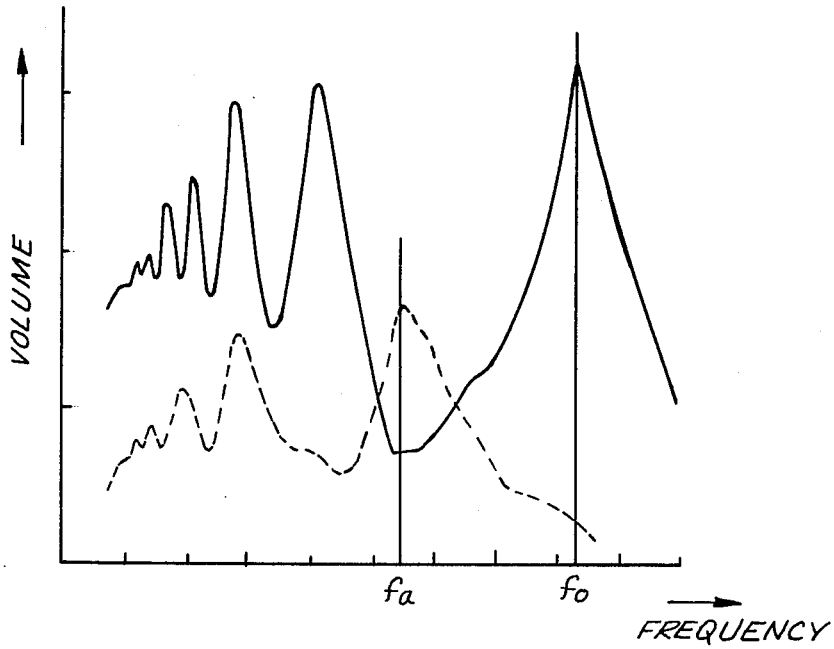

In the same manner as FIG. 4, each frequency characteristic when the watch is worn and not worn in the case where the natural frequencies of the back cover are varied is examined. FIG. 5 depicts the characteristics of the low natural frequency of the back cover, that is, about 5 kHz. FIG. 6 depicts the characteristics of the high natural frequency of the back cover, that is, about 8 kHz. In each graph, the solid line shows the frequency characteristic when the watch is not worn and the broken line shows the frequency characteristic when the watch is worn. As in FIG. 4, the abscissa axis represents the driving frequency and the ordinate axis represents the sound pressure level or volume. In both cases, at or near the natural frequency $f_a$ of back cover when the watch is worn, the closeness of the sound pressure levels as depicted in FIG. 4 is not seen, and there is a great difference of sound pressure levels between when the watch is worn and when not worn. It is demonstrated from these tests that the realization of a piezoelectric buzzer which has the frequency characteristic as depicted in FIG. 4 is possible. A piezoelectric buzzer in which a person does not detect the slight volume difference of the sound pressure levels between when the watch is worn and when not worn is thus presented by the present invention. The instant invention has realized such a piezoelectric buzzer by determining the natural frequency $f_o$ of the case back.

The basis of determination of $f_a$, is of course, to decrease the difference of the sound pressure levels at the buzzer driving frequency. As discussed above, if the driving frequency $f_o$ is changed to $f_a$ when the watch is worn, the high sound pressure level or volume will always be obtained. However, as it is difficult to detect this situation, it is accordingly very difficult to change the frequency automatically. Accordingly, the driving frequency is fixed.

In the instant invention, on account of the following two reasons, the driving frequency of piezoelectric element 2 is set to be 4,096 Hz. First, a person senses the sound of about 3 to 4 kHz most loudly with his sense of hearing, and secondly, the frequency of 4,096 Hz can be easily obtained by dividing the frequency of a tuning fork type quartz oscillator, that is, of 32,768 Hz. The experimental sound pressure levels or volumes measured at the frequency of 4,096 Hz when the watch is worn and not worn is depicted in FIG. 7 in the same manner as depicted in FIGS. 4 through 6. The axis of the abscissa represents the natural frequency, and the axis of the ordinate represents the sound pressure level or volume. The solid line shows the sound pressure level when the watch is not worn and the broken line shows the sound pressure level when the watch is worn. The solid points defining the solid line and the outlined circled points defining the broken line are actual experimentally measured points. If the natural frequency of the back cover, that is, of the piezoelectric buzzer is set between 5.5 kHz and 7 kHz, the difference of the sound pressure levels when the watch is worn and when not worn is extremely little.

For the reasons discussed above, in this invention, the natural frequency of the piezoelectric buzzer is set between 5.5 kHz and 7 kHz in a piezoelectric buzzer where the piezoelectric element is directly attached to the back cover or case back which serves as the vibration plate. The relation between the sound pressure level and the frequency as shown in FIG. 7 is realized at the frequency near 4 kHz, that is, 4.096 Hz.

In wristwatches presently on the market, the shape of the back cover is determined taking into consideration the strength, design, thickness and the like and the object of this invention is never considered. In the case of a thin back cover, it is generally easy to control the increase of the natural frequency by thickening the back cover. Where a thick back cover is used such as in a water resistant watch, the natural frequency of the watch can be as high as about 10 kHz. To put this invention into practical use, the natural frequency must be decreased. Accordingly, alternative methods of decreasing the natural frequency of the back cover are explained hereinafter.

In general, the natural frequency of the case back is proportional to the thickness of the case back and is inversely proportional to the square of the radius (area) of the case back. Accordingly, if the outer diameter of the case back is determined, the thickness of the case back can be selected so that the natural frequency is between 5.5 kHz and 7.0 kHz. It is noted, however, that this calculated thickness is not precise since the shape of the case back and the coupling of the case back to the watch case will alter this calculated value slightly.

With reference to FIG. 8, a method of decreasing the natural resonance frequency of a case back 12 is depicted. In case back 12 which includes a threaded portion 12*a* for screwing onto the watch case of a wristwatch, the piezoelectric element 11 is centrally attached to back cover 12. A circular groove 13 which surrounds piezoelectric element 11 is formed into case back 12. The natural frequency of the case back can be decreased by suitably selecting the width and depth of groove 13.

FIG. 9 graphically depicts the relation between the depth of the groove 13 and the sound pressure level or volume. The axis of the abscissa represents the ratio of the thickness of the case back 12 to the depth of groove 13, and the axis of the ordinate represents the natural frequency of the case back. The general thickness of the case back used in determining the graph of FIG. 9 is 0.8 mm. Where groove 13 has a width of more than 1 mm, the tendency depicted in FIG. 9 does not change. By examining FIG. 9 it is found that with respect to groove 13 having a width greater than 1 mm, the natural frequency of the back cover can be remarkably decreased by providing a depth for the groove which is more than one fourth of the thickness of the case back.

Referring now to FIG. 10 an alternative embodiment of a rectangular-shaped case back 15 having a piezoelectric element 16 attached to a central portion thereof, is depicted. Triangular grooves 17 are cut into each of the four corners of case back 15. In FIG. 10, the depth of each of the grooves is more than one fourth of that of case back 15.

According to the instant invention, a piezoelectric buzzer in which a person does not sense the difference of the sound pressure level or volume between when a watch is worn and when it is not worn is offered by setting the natural frequency of the case back to be between 5.5 kHz and 7 kHz. The buzzer is simply constructed so that the case back of the watch case of the wristwatch serves as the vibrating plate. Accordingly, by constructing the piezoelectric buzzer of the wristwatch in the manner described, a substantial advance in the art is presented.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a wristwatch having a watch case and a case back releasably secured to said watch case, said case back having a lower surface defining an interior side and an opposite exterior side, the exterior side of the lower surface of said case back contacting the wrist of a wearer when said wristwatch is worn, the improvement comprising a piezoelectric element coupled to the interior side of the lower surface of said case back inside said watch case so that the lower surface of said case back acts as a vibration plate means for said piezoelectric element, said case back having a natural resonance frequency when said wristwatch is not worn and an apparent resonance frequency when said wristwatch is worn and in contact with the skin of a wearer, driver means for producing a driving signal for driving said piezoelectric element, the frequency of said driving signal being proximate to the apparent resonance frequency of said case back when said wristwatch is worn, the natural resonance frequency of said case back when said wristwatch is not worn being set to between about 5.5 kHz and 7.0 kHz, said case back being formed so that the apparent resonance frequency of said case back is about 4 kHz whereby the volume of sound from said piezoelectric element and said case back when driven by said driving signal does not substantially vary when said wristwatch is worn and when not worn.

2. The wristwatch as claimed in claim 1, wherein said driving signal has a frequency of about 4 kHz.

3. The wristwatch as claimed in claim 1, wherein said case back has a natural resonance frequency between about 5.5 kHz and 7.0 kHz.

4. The wristwatch as claimed in claim 2, wherein said case back has a natural resonance frequency between about 5.5 kHz and 7.0 kHz.

5. The wristwatch as claimed in claim 2, wherein said driving signal has a frequency of about 4,096 Hz.

6. The wristwatch as claimed in claim 2, wherein the interior side of said case back includes a groove cut therein for the regulation of the resonant frequency thereof.

7. The wristwatch as claimed in claim 6, wherein said groove surrounds said piezoelectric element coupled to said case back.

8. The wristwatch as claimed in claim 2, wherein said case back is rectangular, said case back including grooves cut therein on the interior side thereof.

9. The wristwatch as claimed in claim 8, wherein said grooves are triangular, one said groove being cut into each corner of said rectangular case back.

10. The wristwatch as claimed in claim 7, wherein the depth of said groove is more than one fourth of the thickness of said case back.

11. The wristwatch as claimed in claim 9, wherein the depth of each said groove is more than one fourth of the thickness of said case back.

12. The wristwatch as claimed in claim 5, wherein the diameter of said case back is predetermined so that said case back can be releasably secured to said watch case, the thickness of said case back being selected so that the natural resonance frequency of said case back is between about 5.5 kHz and 7.0 kHz.

13. The wristwatch as claimed in claim 12, wherein the natural resonance frequency of said case back is proportional to the thickness of said case back and is inversely proportional to the square of the radius of said case back.

14. A method of driving a piezoelectric buzzer in a wristwatch having a case back wherein said buzzer includes a piezoelectric element coupled to the interior surface of a case back so that said case back acts as a vibration plate for said piezoelectric element, said wristwatch having a watch case of a selected shape and size, comprising the steps of:

forming said case back in a size and shape so that said case back can be releasably secured to said watch case, setting the resonance frequency of said case back to between about 5.5 kHz and 7.0 kHz when said wristwatch is not worn, applying a driving signal of about 4 kHz to said piezoelectric element, and selectively adjusting the size and shape of said case back so that the apparent resonance frequency of said case back is about 4 kHz when said wristwatch is worn whereby the volume of sound from said piezoelectric element and said case back does not substantially vary when said wristwatch is worn and when not worn.

15. The method, as claimed in claim 13, wherein the thickness of said case back is selected so that the natural resonance frequency of said case back is between about 5.5 kHz and 7.0 kHz.

16. The method, as claimed in claim 13, further comprising the step of cutting at least one groove in said case back, the depth of said groove being selected so that the natural resonance frequency of said case back is between about 5.5 kHz and 7.0 kHz.

17. The method, as claimed in claim 15, wherein the depth of said groove is more than one fourth the thickness of said case back.

* * * * *